US009620914B2

(12) United States Patent
Park et al.

(10) Patent No.: US 9,620,914 B2
(45) Date of Patent: Apr. 11, 2017

(54) ELECTRONIC DEVICE

(71) Applicant: Samsung Electronics Co., Ltd., Gyeonggi-do (KR)

(72) Inventors: Jung Bae Park, Daegu (KR); Yong Won Cho, Gyeongsangbuk-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/672,349

(22) Filed: Mar. 30, 2015

(65) Prior Publication Data

US 2015/0280357 A1 Oct. 1, 2015

(30) Foreign Application Priority Data

Mar. 28, 2014 (KR) ..... 10-2014-0036460

(51) Int. Cl.

| | |
|---|---|
| ***H01R 13/58*** | (2006.01) |
| ***H01R 13/74*** | (2006.01) |
| ***H01R 13/56*** | (2006.01) |
| *H01R 24/62* | (2011.01) |
| *H01R 33/975* | (2006.01) |

(52) U.S. Cl.

CPC ..... *H01R 13/74* (2013.01); *H01R 13/56* (2013.01); *H01R 24/62* (2013.01); *H01R 33/975* (2013.01)

(58) Field of Classification Search

CPC ..... H01R 13/6277; H01R 13/65802; H01R 13/74; H01R 12/716; H01R 12/7047; H01R 13/518; H01R 13/6581; H01R 13/748; H01R 24/76

USPC ..... 439/449, 564, 567, 573

See application file for complete search history.

(56) References Cited

U.S. PATENT DOCUMENTS 6,875,052 B1 * 4/2005 Lo ..... G06F 1/266 439/545
6,976,876 B1 * 12/2005 Su ..... H01R 13/6583 439/357
7,121,878 B2 * 10/2006 Chang ..... H01R 13/743 439/564
7,628,638 B2 * 12/2009 Wu ..... H01R 9/032 439/353

(Continued)

FOREIGN PATENT DOCUMENTS

KR 10-2011-0125486 A 11/2011

*Primary Examiner* — Xuong Chung Trans
(74) *Attorney, Agent, or Firm* — Cha & Reiter, LLC

(57) ABSTRACT

An electronic device is provided which includes an insertion terminal, a body part, and a support plate part. The insertion terminal has an insertion hole into which an insertion jack is inserted. The body part supports the insertion terminal at one side of the insertion terminal. The support plate part has a support surface being a surface opposite to the insertion terminal and supports the insertion terminal at the other side of the insertion terminal. The body part has an opposite surface opposite to the support surface, a step difference surface having a step difference with the opposite surface and placed to be deeper from the insertion hole on the basis of an insertion direction of an insertion jack than the opposite surface, and an inclined surface joining the opposite surface and the step difference surface. The support plate part transmits the force by which the insertion terminal shakes, to the body part through the inclined surface.

17 Claims, 8 Drawing Sheets

(56) References Cited

U.S. PATENT DOCUMENTS

| | | | | |
|---|---|---|---|---|
| 7,762,852 | B2 * | 7/2010 | Daly | H01R 9/2491<br>439/562 |
| 7,837,500 | B2 * | 11/2010 | Chen | H01R 13/748<br>439/564 |
| 8,485,849 | B2 | 7/2013 | Ahn et al. | |
| 2011/0281463 | A1 | 11/2011 | Ahn et al. | |

* cited by examiner

ELECTRONIC DEVICE

CROSS-REFERENCE TO RELATED APPLICATION

This application claims priority under 35 U.S.C. §119(a) to a Korean Patent Application filed on Mar. 28, 2014 in the Korean Intellectual Property Office and assigned Serial No. 10-2014-0036460, the entire contents of which are incorporated herein by reference.

TECHNICAL FIELD

The present disclosure relates to an electronic device and structural support for an insertion terminal.

BACKGROUND

An electronic device may include a USB charging terminal into which a USB charging jack is inserted to charge electric energy. The USB charging jack may be a jack that is formed at one end of a cable for charging any device through a USB. The USB charging jack may be inserted into the USB charging terminal included in the electronic device to supply the electric energy to the electronic device.

The electronic device may also include a connection terminal into which a connection jack is insertable for connecting with other electronic devices. The connection jack may be a jack formed at one end of a cable for connecting two or more electronic devices. The connection jack may be inserted into the connection terminal of the electronic device and may allow the electronic device to perform data communication with another electronic device.

A manner of inserting the USB charging jack into the USB charging terminal or a manner of inserting the connection jack into the connection terminal may be the same as a manner of inserting the insertion jack into a general insertion terminal.

When (or after) an insertion jack is inserted into the insertion terminal, the insertion jack may move or shake excessively due to weight of one or more of the components, or because of external force. In addition, any movement of the insertion jack may be transmitted up to the insertion terminal into which the insertion jack is inserted, thereby causing the insertion terminal to move or shake as well.

SUMMARY

Accordingly, an aspect of the present disclosure provides an electronic device capable of effectively supporting an insertion terminal by transmitting the force causing the insertion terminal to move or shake to an entirety of the electronic device.

Another aspect of the present disclosure provides an electronic device capable of more stably supporting an insertion terminal when a force is applied to the insertion terminal.

Still another aspect of the present disclosure provides an electronic device capable of supporting an insertion terminal using a material that is non-deformable, having high rigidity, and corrosion-resistant properties In accordance with an aspect of the present disclosure, provided is an electronic device which includes an insertion terminal, a body part, and a support plate part. The insertion terminal may have an insertion hole into which an insertion jack is inserted. The body part may support the insertion terminal at one side of the insertion terminal. The support plate part may have a support surface being a surface opposite to the insertion terminal and may support the insertion terminal at the other side of the insertion terminal. The body part may have an opposite surface opposite to the support surface, a step difference surface having a step difference with the opposite surface and placed to be deeper from the insertion hole on the basis of an insertion direction of an insertion jack than the opposite surface, and an inclined surface joining the opposite surface and the step difference surface. The support plate part may transmit the force by which the insertion terminal shakes, to the body part through the inclined surface.

In accordance with an aspect of the present disclosure, provided is an electronic device which includes an insertion terminal, a body part, and a support plate part. The insertion terminal may have an insertion hole into which an insertion jack is inserted. The body part may support the insertion terminal at one side of the insertion terminal. The support plate part may have a support surface being a surface opposite to the insertion terminal and may support the insertion terminal at the other side of the insertion terminal. The support plate part may transmit the force by which the insertion terminal shakes, to the body part through the step difference surface without passing through the inclined surface.

BRIEF DESCRIPTION OF THE DRAWINGS

The present disclosure will be more apparent from the following description, taken in conjunction with the accompanying drawings, in which.

DETAILED DESCRIPTION

Figure 1:
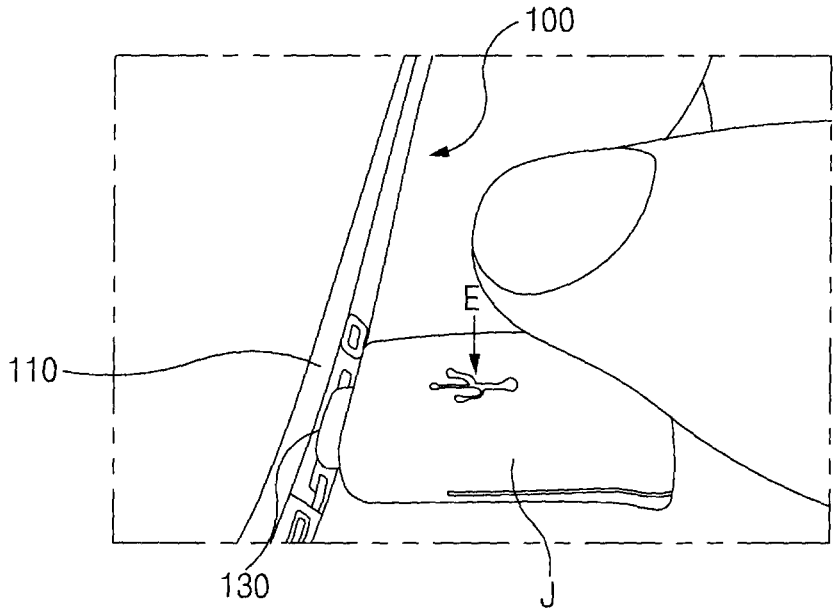
FIG. 1 is a diagram schematically illustrating a state where an insertion jack is inserted into an insertion terminal included in an electronic device according to an example embodiments of the present disclosure.

Hereinafter, the present disclosure is described with reference to the accompanying drawings. Various modifications are possible in various embodiments of the present disclosure and embodiments are illustrated in drawings and related detailed descriptions are listed. Thus, it is intended that the present disclosure covers modifications and variations of this disclosure provided they relate to the appended claims and their equivalents. With respect to the descriptions of the drawings, like reference numerals refer to like elements.

The terms "include," "comprise," and "have", or "may include," or "may comprise" and "may have" used herein indicate disclosed functions, operations, or existence of elements but does not exclude other functions, operations or elements. Additionally, in this specification, the meaning of "include," "comprise," "including," or "comprising," specifies a property, a region, a fixed number, a step, a process, an element and/or a component but does not exclude other properties, regions, fixed numbers, steps, processes, elements and/or components.

The meaning of the term "or" used herein includes any or all combinations of the words connected by the term "or". For instance, the expression "A or B" may indicate include A, B, or both A and B. As used herein, the term "and/or" includes any and all combinations of one or more of the associated listed items.

The terms such as "1st", "2nd", "first", "second", and the like used herein may refer to modifying various different elements of various embodiments, but do not limit the elements. For instance, such terms do not limit the order and/or priority of the elements. Furthermore, such terms may be used to distinguish one element from another element. For instance, both "a first user device" and "a second user device" indicate a user device but indicate different user devices from each other For example, a first component may be referred to as a second component and vice versa without departing from the present disclosure.

In the description below, when one part (or element, device, etc.) is referred to as being "connected" to another part (or element, device, etc.), it should be understood that the former can be "directly connected" to the latter, or "electrically connected" to the latter via an intervening part (or element, device, etc.). It will be further understood that when one component is referred to as being "directly connected" or "directly linked" to another component, it means that no intervening component is present.

Terms used in this specification are used to describe embodiments of the present disclosure and are not intended to limit the present disclosure. The terms of a singular form may include plural forms unless otherwise specified.

Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal sense unless expressly so defined herein in various embodiments of the present disclosure.

An electronic device according to various embodiments of the present disclosure may have a communication function. For instance, electronic devices may include at least one of smartphones, tablet Personal Computers (PCs), mobile phones, video phones, electronic book (e-book) readers, desktop PCs, laptop PCs, netbook computers, Personal Digital Assistants (PDAs), Portable Multimedia Players (PMPs), Moving Picture Experts Group Audio Layer 3 (MP3) players, mobile medical devices, cameras, or wearable devices (e.g., Head-Mounted-Devices (HMDs) such as electronic glasses, electronic apparel, electronic bracelets, electronic necklaces, electronic appcessory, electronic tattoos, or smart watches).

According to some embodiments of the present disclosure, an electronic device may be smart home appliances having a communication function. The smart home appliances may include at least one of, for example, televisions, Digital Video Disk (DVD) players, audio devices, refrigerators, air conditioners, cleaners, ovens, microwave ovens, washing machines, air cleaners, set-top boxes, TV boxes (e.g., Samsung HomeSync™, Apple TV™ or Google TV™), game consoles, electronic dictionaries, electronic keys, camcorders, or electronic picture frames.

According to embodiments of the present disclosure, an electronic device may include at least one of various medical devices (for example, Magnetic Resonance Angiography (MRA) devices, Magnetic Resonance Imaging (MRI) devices, Computed Tomography (CT) devices, medical imaging devices, ultrasonic devices, etc.), navigation devices, Global Positioning System (GPS) receivers, Event Data Recorders (EDRs), Flight Data Recorders (FDRs), vehicle infotainment devices, marine electronic equipment (for example, marine navigation systems, gyro compasses, etc.), avionics, security equipment, car head units, industrial or household robots, financial institutions' Automated Teller Machines (ATMs), or stores' Point Of Sale (POS) systems.

According to an embodiment of the present disclosure, an electronic device may include at least one of furniture or buildings/structures having a communication function, electronic boards, electronic signature receiving devices, projectors, or various measuring instruments (for example, water, electricity, gas, or radio signal measuring instruments). An electronic device according to an embodiment of the present disclosure may be one of the above-mentioned various devices or a combination thereof. Additionally, an electronic device according to an embodiment of the present disclosure may be a flexible device. Furthermore, it is apparent to those skilled in the art that an electronic device according to an embodiment of the present disclosure is not limited to the above-mentioned devices.

In the description below, it will be understood that when an element such as a layer, region, substrate, part, portion, plate, or member is referred to as being "on" another element, it can be directly on the other element or intervening elements may be present. In contrast, the term "directly" means that there are no intervening elements.

Hereinafter, an electronic device according to various embodiments of the present disclosure will be described in more detail with reference to the accompanying drawings. The term "user" in various embodiments may refer to a person using an electronic device or a device using an electronic device (for example, an artificial intelligent electronic device).

Figure 2:
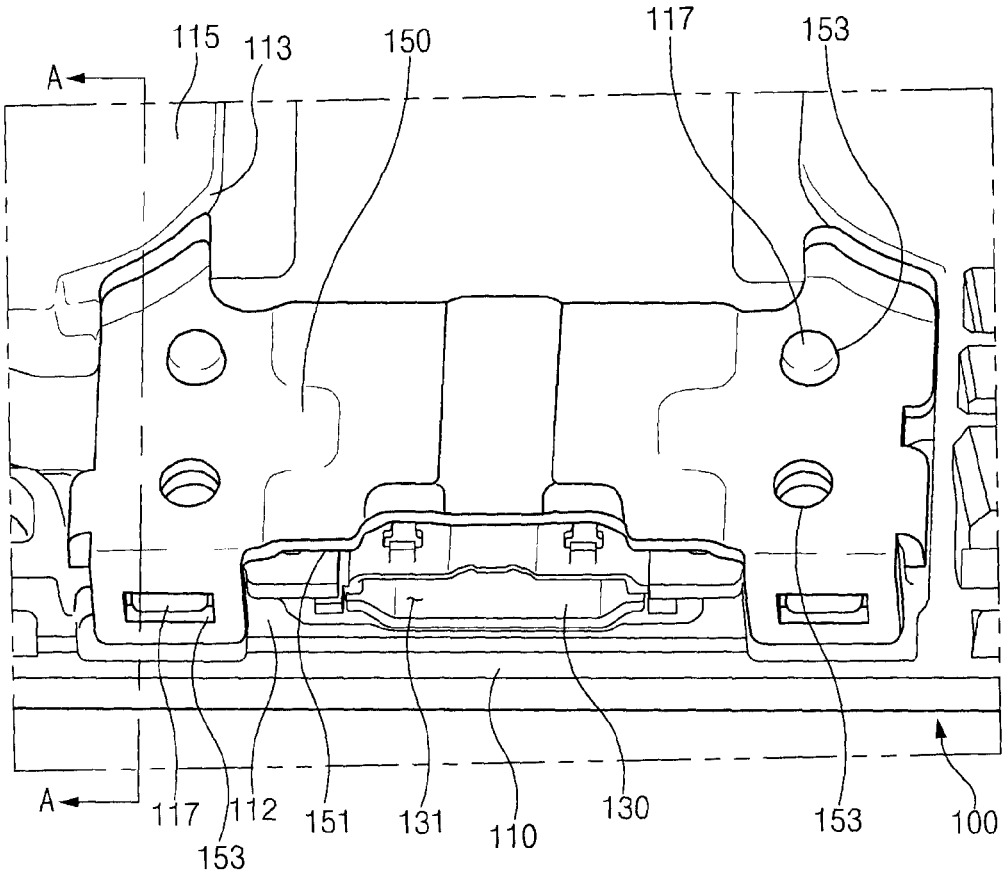
FIG. 2 is a perspective view of an electronic device according to an example embodiment of the present disclosure.
Figure 3:
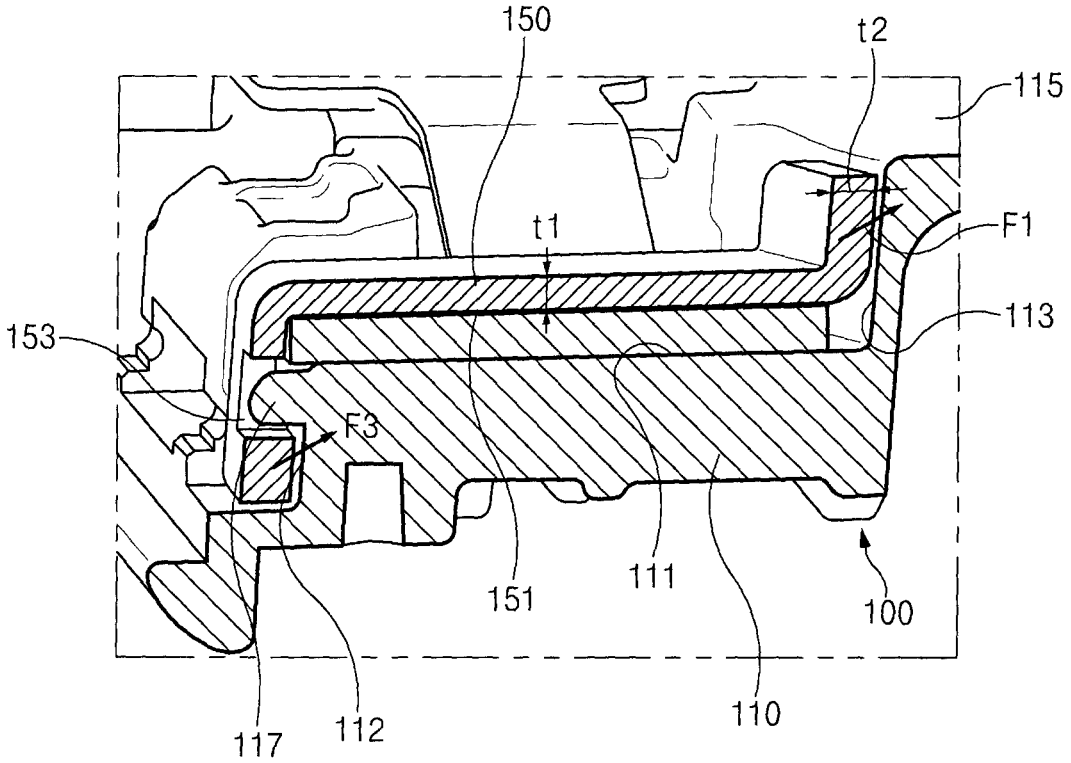
FIG. 3 is a cross-sectional view taken along a line A-A of FIG. 2.

FIG. 1 is a diagram schematically illustrating a state where an insertion jack is inserted into an insertion terminal included in an electronic device according to an example embodiment of the present disclosure. FIG. 2 is a perspective view of an electronic device according to an example embodiment of the present disclosure. FIG. 3 is a cross-sectional view taken along a line A-A of FIG. 2.

Hereinafter, an electronic device according to one of various embodiments of the present disclosure will be more fully described with reference to FIGS. 1 to 3.

An electronic device 100 according to one of various embodiments of the present disclosure may contain an insertion terminal 130, a body part 110, and a support plate part 150.

Referring to FIGS. 1 and 2, the insertion terminal 130 may be a terminal into which an insertion jack J is inserted. In FIG. 1, an embodiment of the present disclosure is exemplified as the insertion jack J is inserted into the insertion terminal 130. In FIG. 2, an embodiment of the present disclosure is exemplified as the insertion jack J is removed from the insertion terminal 130. As illustrated in FIG. 2, the insertion terminal 130 may have an insertion hole 131. The insertion hole 131 may mean an inlet at which the insertion jack J enters.

The body part 110 may support the insertion terminal 130 at one side of the insertion terminal 130. The body part 110 may suppress shaking of the insertion terminal 130 at the one side of the insertion terminal 130. The body part 110 may contact (or face or otherwise partially enclose) the insertion terminal 130. However, it may be possible to arrange the body part 110 and the insertion terminal 130 so as that they do not contact one another.

The support plate part 150 may have a support surface 151 that is a surface opposite to the insertion terminal 130, and may support the insertion terminal 130 at the other side of the insertion terminal 130. The support plate part 150 may restrict the shaking of the insertion terminal 130 through the support surface 151 at the other side of the insertion terminal 130. The support surface 151 may contact with the insertion terminal 130. However, it may be possible to arrange the support surface 151 and the insertion terminal 130 so as not to contact with each other.

Referring to FIG. 3, the body part 110 may have an opposite surface 111, a step difference surface 115, and an inclined surface 113. The opposite surface 111 may be a surface that is opposite to the support surface 151. The opposite surface 111 may be a surface facing the support surface 151. The opposite surface 111 may contact the support surface 151. However, it is also possible that the opposite surface 111 does not contact the support surface 151.

The step difference surface 115 may be formed to have a step difference with the opposite surface 111. The existence of a step difference may indicate heights of two surfaces measured from any point are different from each other.

Also, the step difference surface 115 may be disposed deeper or more inwards from the insertion hole 131 on the basis of an insertion direction of an insertion jack J relative to where the opposite surface 111 is located. However, the disposition of a structure deeper or more inwards from the insertion hole 131 does not mean that an entire or whole portion of the step difference surface 115 must be or is further or deeper from the insertion hole 131 than the whole portion of the opposite surface 111. It is understood that the present disclosure contemplates the situation where the step difference surface 115 is disposed farther (in distance) or deeper (in depth) from the insertion hole 131, relative to the opposite surface. Thus, a location of the step difference surface 115 may be disposed deeper based on, for example, an insertion direction of the insertion jack J, rather than that of the opposite surface 111.

The inclined surface 113 may be a surface that joins the opposite surface 111 and the step difference surface 115. It is understood that the disclosure may also include the situation where the inclined surface 113 forms any angle with the step difference surface 115, regardless of an angle between the inclined surface 113 and the opposite surface 111. A surface joining the opposite surface 111 and the step difference surface 115 may be the whole inclined surface 113. The term "joining" or "connecting" should not be construed to mean only direct joining or connection, but is intended to also encompass both direct joining and indirect joining or connection through another object.

Referring again to FIG. 1, when or after being inserted into the insertion terminal 130, the insertion jack J may in some circumstances be moved in a variety of directions due to its own weight or an applied external force E. Accordingly, the insertion terminal 130 may be excessively moved or shaken according to a movement of the insertion jack J. The support plate part 150 may transmit the force causing the insertion terminal 130 to move to the body part 110 through the above-described inclined surface 113. Here, the force transmitted from the support plate part 150 to the body part 110 through the inclined surface 113 is designated "F1" (as depicted in FIG. 3).

The support plate part 150 may shake according to shaking of the insertion terminal 130, which means that the support plate part 150 transmits shaking force to the body part 110 through the inclined surface 113. In this case, the shaking of the support plate part 150 may be transmitted up to a portion of the body part 110 that is placed to be farther (in distance) or deeper (in depth) into the body of the device relative to the insertion hole 131. At this time, the force transmitted to the body part 110 may be transmitted to the whole electronic device 100.

In the above-described structure, the electronic device 100 according to various embodiments of the present disclosure may allow transmission of the force causing the insertion terminal 130 to shakes to the whole electronic device 100, thereby facilitating effective structural support the insertion terminal 130.

The body part 110 may have an extended surface 112 that is curved and extended at one end of the opposite surface 111 in a direction away from the step difference surface 115 to the opposite surface 111. In this case, the opposite surface 111 may be placed at the center between the extended surface 112 and the step difference surface 115. The opposite surface 111 and the extended surface 112 may be joined angularly to make an angle between the opposite surface 111 and the extended surface 112. However, two surfaces can be joined smoothly in a curved shape. Two surfaces not only may be jointed directly, but they may be jointed indirectly through other intermediate.

At this time, the support plate part 150 may additionally transmit the force causing the insertion terminal 130 to shake to the body part 110 through the extended surface 112. Here, the force transmitted from the support plate part 150 to the body part 110 through the extended surface 112 may be denoted by "F3" (as seen in FIG. 3).

The force may not only be transmitted by direct contact, but may also be transmitted through another object. The shaking force may be transmitted additionally to the body part 110 through the extended surface 112, thereby making it possible to distribute the shaking force to support the insertion terminal 130. In other words, the support plate part 150 may more stably support the insertion terminal 130 during movement or shaking.

The support plate part 150 may be made of a metal material. Since metal is a material having high intensity and solidity, it may support the insertion terminal 130 without large deformation. In particular, it may be desirable to use a stainless steel (SUS) metal material. Since steel is a material having high intensity and solidity and further includes a corrosion resistant characteristic, stainless steel (SUS) may effectively prevent corrosion of the support plate part 150.

In one example embodiment of the present disclosure, the support plate part 150 includes a metal material. However, the support plate part 150 is not limited to the metal material. As well as a metal material, a material over predetermined rigidity may be used as a material forming the support plate part 150. A material having rigidity equal to or higher than stainless steel material can be used.

The support plate part 150 may adhere (i.e., be affixed) to the body part 110 through an adhesive. When the support plate part 150 is affixed to the body part 110 through the adhesive, the shaking force of the support plate part 150 all may be transmitted to the body part 110 regardless of an orientation in which the support plate part 150 is shaken. Accordingly, the support plate part 150 may more strongly support the insertion terminal 130 in all directions by its coupling to the support plate part 150 on the body part 110 through the adhesive.

The above-described effect may be obtained when the whole portion of the support plate part 150 joins to the body part 110 through the adhesive, as well as when a mere portion of the support plate part 150 joins to the body part 110 through the adhesive.

A portion of the support plate part 150 placed on the opposite surface 111 may be thicker than a portion of the support plate part 150 placed on the inclined surface 113. Referring to FIG. 3, a thickness of the support plate part 150 placed on the opposite surface 111 may be denoted by "t1", and a thickness of the support plate part 150 placed on the inclined surface 113 may be denoted by "t2". That a thickness of the support plate part 150 placed on the opposite surface 111 is thicker than that of the support plate part 150 placed on the inclined surface 113 may mean that "t1" is greater than "t2".

Since a portion of the support plate part 150 placed on the inclined surface 113 is used for transmitting force, damage of the support plate part 150 may be prevented by forming the relevant portion of the support plate part 150 with considerations of a sufficient thickness.

The support plate part 150 may have a through-hole (or penetration hole) 153. The though-hole 153 may be a hole penetrating the full breadth or width of the support plate part 150. An example through-hole 153 is illustrated in FIGS. 2 and 3.

As the through-hole 153 is formed in the support plate part 150, it may be possible to lighten a weight of the support plate part 150 by reducing the quantity of material forming the support plate 150. Reducing of the material may be advantageous in terms of cost. Even though the weight of the support plate part 150 is reduced by forming the through-hole 153, the support plate part 150 may continue to prevent undesired shaking of the insertion terminal 130 as effectively as if no through-holes were form in it. The body part 110 may have a first projection part 117 which is inserted through the through-hole 153. In FIG. 2, an embodiment of the present disclosure is exemplified as the first projection part 117 is inserted through some of through-holes 153.

The first projection part 117 may be formed to fit to the size of the through-hole 153 and may be inserted into the through-hole 153. The first projection part 117 may prevent the support plate part 150 from excessive shaking or movement in a variety of directions, such as left, right, etc. In this structure, the first projection part 117 may effectively prevent the support plate part 150 from leaving from its designated and/or intended position.

Though not shown, the support plate part 150 may have a groove, and the body part 110 may have a second projection part that is inserted into the groove.

Instead of the through-hole 153, a groove may be formed at the support plate part 150. The through-hole 153 may be a fully opened hole (or penetration hole), and the groove may be a hole the one side of which is only opened, but not having both sides of it opened. The second projection part may have a shape corresponding to the groove, and may be inserted therein. Similarly to the first projection part, the second projection part may be formed at the body part 110, so as to be projecting away from the body part 110.

The groove and the second projection part may prevent undue movement, such as sliding, between the support plate part 150 and the body part 110. If no sliding occurs when the support plate part 150 transmits force to the body part 110, the force causing the insertion terminal 130 shakes may be transmitted efficiently to the body part 110, which thus provides adequate support for the various structural components.

Figure 4:
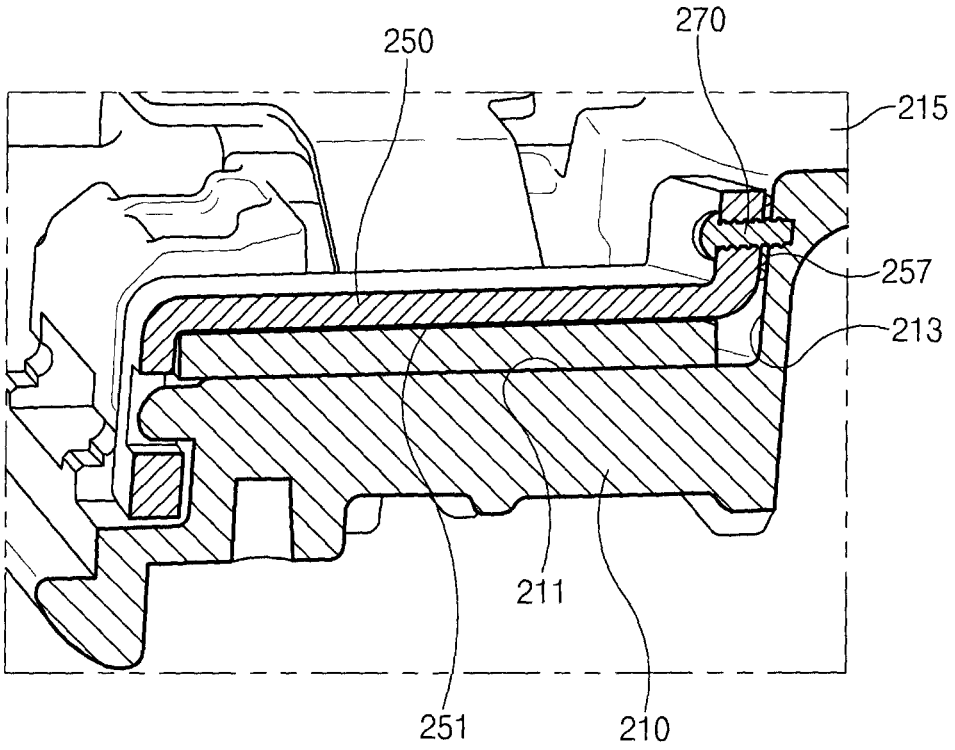
FIG. 4 is a cross-sectional view schematically illustrating an electronic device according to an example embodiment of the present disclosure.

FIG. 4 is a cross-sectional view schematically illustrating an electronic device according to an example embodiment of the present disclosure.

An electronic device may have a configuration similar to an electronic device according to the embodiment described above. However, another embodiment may differ from the above described embodiment in that in that the supporting force of a support plate part may be strengthened.

For reference, parts that are identical (or correspond) to those described above may be marked by the same (or corresponding) reference numerals, and a detailed description of these repeating parts is thus omitted.

Hereinafter, an electronic device according to an example embodiment of the present disclosure will be more fully described with reference to FIG. 4.

A support plate part 250 may include a projection shape 257 on a surface thereof. In FIG. 4, an embodiment of the present disclosure is exemplified as the projection shape 257 is formed at a portion of the support plate part 250 opposite to an inclined surface 213. The projection shape 257, as illustrated in FIG. 4, may strengthen frictional force(s) between the support plate part 250 and the inclined surface 213. The projection shape 257 may prevent sliding between the support plate part 250 and the inclined surface 213.

When the support plate part 250 has a large coefficient of friction, and is formed in a shape capable of generating a large frictional force, the force causing an insertion terminal to shake may be transmitted effectively to the body part 210, thereby facilitating effective support for the shaking of the insertion terminal.

The support plate part 250 may include a surface that is treated to have high friction by a sand blasting technique. Similarly to the projection shape 257 formed on a surface of the support plate part 250, the surface treated by the sand blasting technique may strengthen frictional force between the support plate part 250 and the inclined surface 213 and may also prevent sliding between the support plate part 250 and the inclined surface 213.

Meanwhile, the support plate part 250 may be joined to the body part 210 through a mechanical fastener, such as bolt 270. As illustrated in FIG. 4, the bolt 270 may pass through the support plate part 250 and the inclined surface 213 and then may be inserted into the body part 210. According to this structure, the support plate part 250 may be joined or coupled tightly to the body part 210 by the bolt 270.

When being joined tightly to the body part 210 using the bolt 270, the support plate part 250 may support an insertion terminal more securely.

Figure 5:
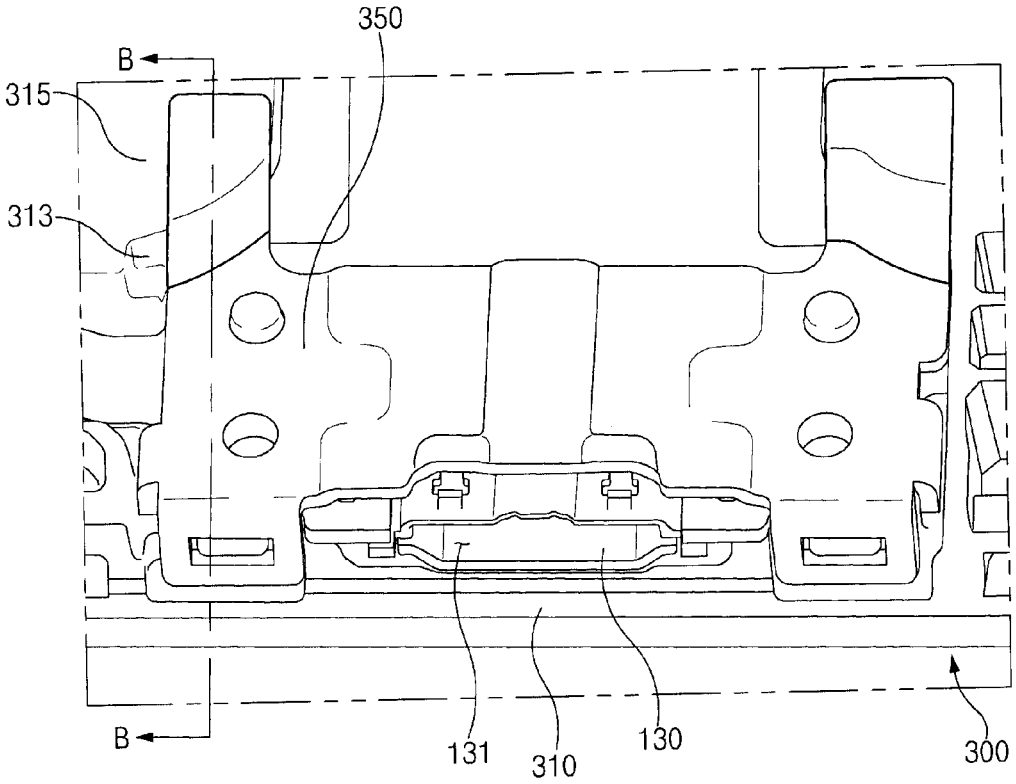
FIG. 5 is a perspective view schematically illustrating an electronic device an example embodiment of the present disclosure.
Figure 6:
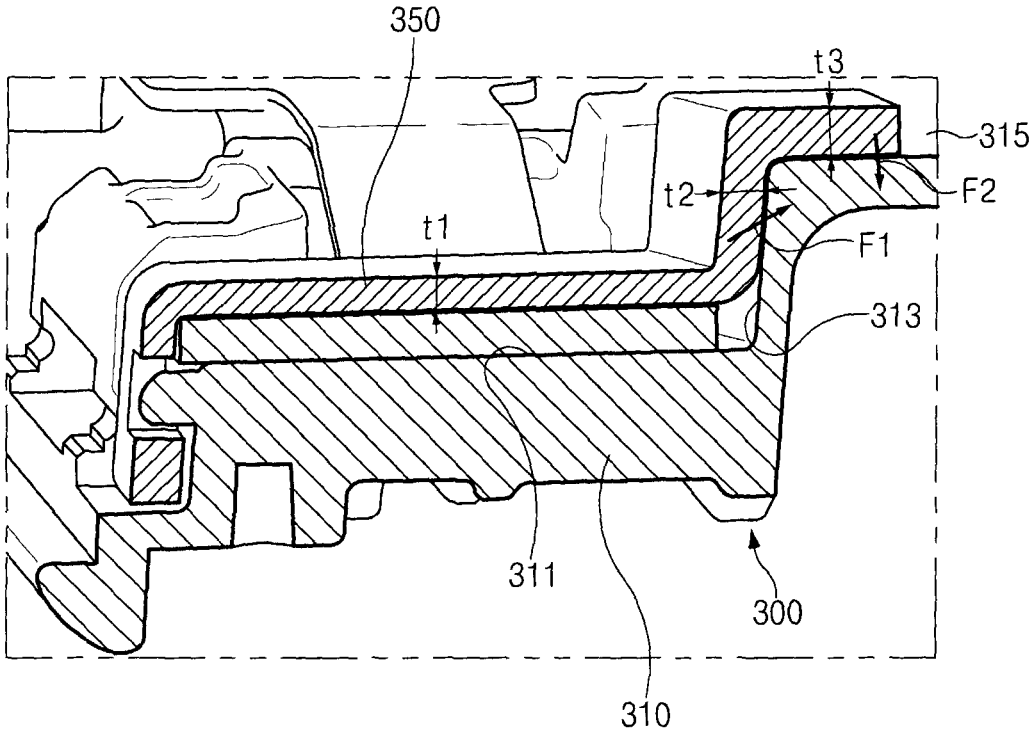
FIG. 6 is a cross-sectional view taken along a line B-B of FIG. 5.

FIG. 5 is a perspective view schematically illustrating an electronic device of an example embodiment of the present disclosure. FIG. 6 is a cross-sectional view taken along a line B-B of FIG. 5.

An example electronic device of the present disclosure may have a configuration similar to an electronic device configured to implement the above-described embodiments. This particular example embodiment may differ from the above described embodiments in that a support plate part may support an insertion terminal more stably.

For reference, parts that are identical (or correspond) to those described above may be marked by the same (or corresponding) reference numerals, and a detailed description of them is thus omitted.

Hereinafter, an example electronic device of one embodiment of the present disclosure will be more fully described with reference to FIGS. 5 and 6.

In an example electronic device 300, a support plate part 350 may first transmit the force causing an insertion terminal 130 to move or shake to a body part 310 through an inclined surface 313. Here, the force transmitted from the support plate part 350 to the body part 310 through the inclined surface 313 may be denoted "F1".

At this time, the support plate part 350 may transmit the force causing the insertion terminal 130 to move or shake to the body part 310 through a step difference surface 315. Here, the force transmitted from the support plate part 350 to the body part 310 through the step difference surface 315 may be denoted by "F2" (referring now to FIG. 6).

In this case, the support plate part 350 may transmit the force causing the insertion terminal 130 to move or shake to the body part 310 through the step difference surface 315 as well as through the inclined surface 313. Thus, the force by which the insertion terminal 130 shakes or moves is transmitted to the body part 310 over a wider surface, and is also transmitted to the body part 310 through an additional area of the inner surface (that is, a surface closer to the inside or interior of an electronic device).

Since the number of surfaces supporting the movement or shaking of the insertion terminal 130 increases in count from one surface to two surfaces (that is, the inclined surface 313 and the step difference surface 315), the force causing the insertion terminal 130 to shakes may be transmitted to the body part 310 over a wider surface. Accordingly, the support plate part 350 supporting the insertion terminal 130, when using the inclined surface 313 and the step difference surface 315, may be able to support greater forces and movement relative to the case where the support plate part 350 supports the insertion terminal 130 only using the inclined surface 313.

Since the step difference surface 315 is deeper from an insertion hole 131 than the inclined surface 313, the shaking of the support plate part 350 may be transmitted up to a place deeper or more inwards into the device relative to the insertion hole 131. This may indicate that the force causing the insertion terminal 130 to shake is transmitted to a deeper portion of the electronic device 300. Accordingly, the electronic device 300 may better support shaking or movement of the insertion terminal 130.

In the above-described structure, the electronic device 300 according to still another embodiment may allow the force shaking or moving the insertion terminal 130 to be transmitted through a wider surface of the electronic device 300 and through an additional area of an inner surface of the electronic device 300, thereby making it possible to more effectively support the insertion terminal 130 structurally.

A portion of the support plate part 350 placed on at least one of the inclined surface 313 and/or the step difference surface 315 may be formed to be thicker than that of the support plate part 350 placed on the opposite surface 311.

Referring to FIG. 6, a thickness of the support plate part 350 placed on the opposite surface 313 may be denoted "t1," and a thickness of the support plate part 350 placed on the inclined surface 313 may be denoted "t2." Also, a thickness of the support plate part 350 placed on the step difference surface 315 may be denoted "t3."

A portion of the support plate part 350 placed on the inclined surface 313 may be formed thicker than a portion of the support plate part 350 placed on at least one of the inclined surface 313 and/or the step difference surface 315, which may mean that t2 is greater than t1, t3 is greater than t1, and t2 and t3 are greater than t1.

A portion of the support plate part 350 placed on the inclined surface 313 and the step difference surface 315 may be capable of transmitting force. For this reason, damage of the support plate part 350 may be prevented by selecting a thickness t2 or t3 sufficiently thick as to support the support plate part 350 through the anticipated levels of stress, force and movement.

Figure 7:
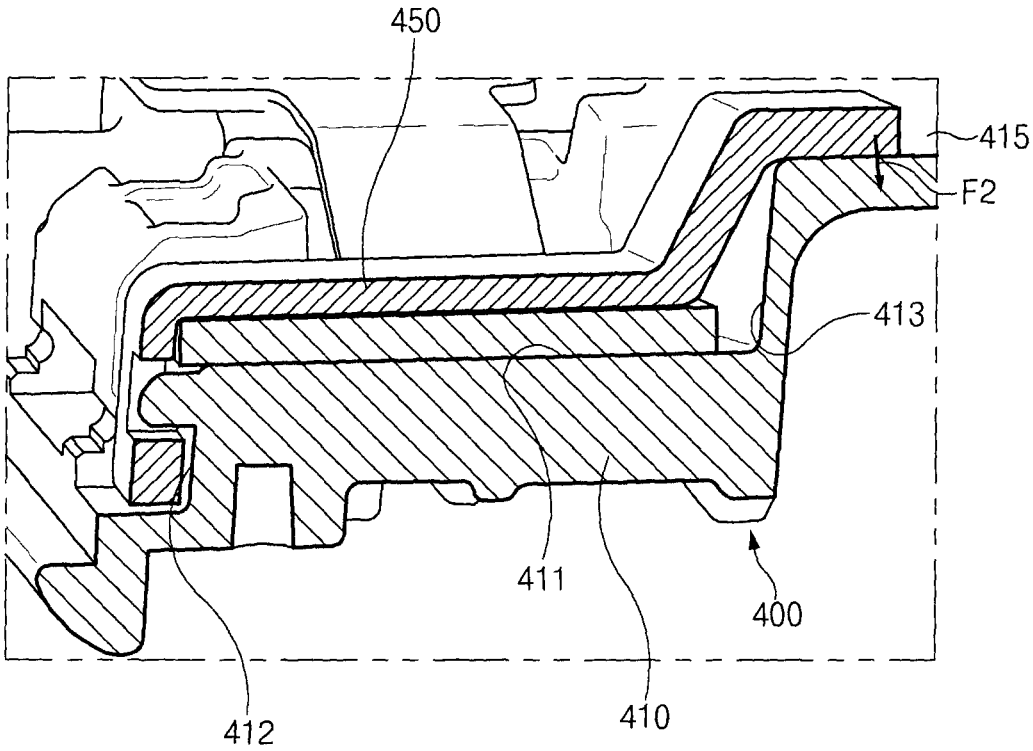
FIG. 7 is a cross-sectional view of an electronic device according to an example embodiment of the present disclosure.

FIG. 7 is a cross-sectional view of an electronic device according to an example embodiment of the present disclosure.

An electronic device this example embodiment of the present disclosure may have a configuration similar to an electronic device according to the other embodiment or embodiments described above. This particular embodiment may differ from the other described embodiment in that the force causing an insertion terminal to move or shake is transmitted to a body part without passing through an inclined surface.

For reference, parts that are identical (or correspond) to parts described above may be marked by the same (or corresponding) reference numerals, and a detailed description of these parts may thus be omitted.

Hereinafter, an electronic device according to an example embodiment of the present disclosure will be more fully described with reference to FIG. 7.

An electronic device 400 according to this particular example embodiment may allow a support plate part 450 to transmit the force by which an insertion terminal shakes, to a body part 410 through a step difference surface 415, not the inclined surface 413. As illustrated in FIG. 7, the support plate part 450 and the inclined surface 413 may be formed to separate from one another, not in contact with one another. In this case, the force may not be transmitted from the support plate part 450 to the inclined surface 413.

Instead, the support plate part 450 may contact with the step difference surface 415 and may transmit the force causing the insertion terminal to move or shake to the body part 410 through the step difference surface 415. The force transmitted from the body part 410 through the step difference part 415 may be denoted by "F2". Unlike FIG. 6, the force F1 may no longer be transmitted from the body part 410 through an inclined portion A length of the support plate part 450 may be shortened when the support plate part 450 and the inclined surface 413 do not contact with each other as described above relative to the case where the support plate part 450 and the inclined surface 413 contact with each other.

A length of the support plate part 450 when the support plate part 450 is formed, as illustrated in FIG. 7, such that it is extended diagonally from the opposite surface 411 toward the step difference surface 415 may become shorter relative to when a support plate part 350 is curved and formed, as illustrated in FIG. 6, such that the support plate part 450 is extended up to a corner portion where an opposite surface 411 and an inclined surface 313 are joined. The reason may be that a length of a hypotenuse of a triangle is shorter than a sum of a length of the bottom side and a height.

The support plate part 450 formed with a shortened length may indicate that shaking and movement of an insertion terminal is prevented and supported while the size and weight of the support plate part 450 are also reduced.

In the above-described structure, the electronic device 400 the particular example embodiment of the present disclosure may allow the force to be transmitted through the step difference surface 415 without passing through the inclined surface 413, thereby reducing the size and weight of the support plate part 450 and saving production costs including materials and workforce for manufacturing the support plate part 450.

In the electronic device 400 according to another example embodiment of the present invention, the body part 410 may have an extended surface 412 that is curved and extended at one end of the opposite surface 411 in a direction away from the step difference surface 415 and towards the opposite surface 411. The opposite surface 411 and the extended surface 412 may be joined angularly to form an angle. However, two surfaces may also be joined smoothly to form a curved shape. In this case, the opposite surface 411 may be placed at the center between the extended surface 412 and the step difference surface 415. The two surfaces not only may be jointed directly, but they may also be jointed indirectly through other intermediate structures.

At this time, the support plate part 450 may additionally transmit the force causing an insertion terminal to shake to the body part 410 through the extended surface 412. Here, the force may not only be transmitted directly, but it may be transmitted indirectly through another interposed structure or object.

In the electronic device 400 according to another embodiment, since the support plate part 450 does not transmit the shaking force of the insertion terminal to the body part 410 through the inclined surface 413, additional transmission of the force to the body part 410 through the extended surface 412 may help to support the insertion terminal stably.

In this structure, the electronic device 400 may strengthen the stability of the insertion terminal.

Hereinafter, an electronic device according to other embodiments of the present disclosure will be described.

Figure 8:
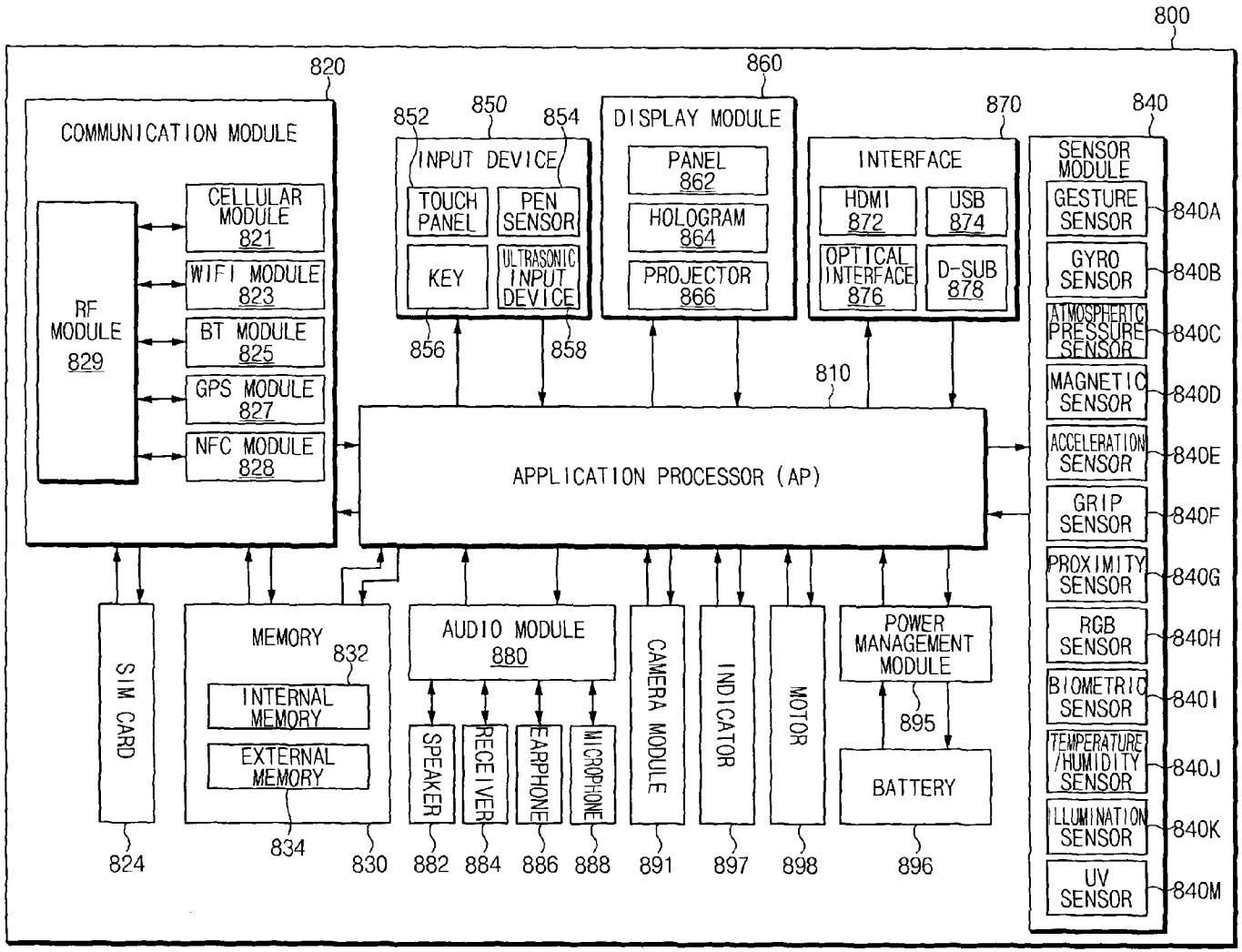
FIG. 8 is a block diagram illustrating an electronic device according to an example embodiment of the present disclosure.

FIG. 8 is a block diagram illustrating an electronic device according to various embodiments of the present disclosure. An electronic device 800 may include, for example, a part or all of components of an electronic device 100 shown in FIG. 1.

Referring to FIG. 8, the electronic device 800 may include at least one of one or more Application Processors (AP) 810, a communication module 820, a Subscriber Identification Module (SIM) card 824, a memory 830, a sensor module 840, an input unit 850, a display 860, an interface 870, an audio module 880, a camera module 891, a power management module 895, a battery 896, an indicator 897, or a motor 898.

The AP 810 may drive an Operating System (OS) or an application to control a plurality of hardware or software components connected to the AP 810 and may process and compute a variety of data including multimedia data. The AP 810 may be implemented with a System on Chip (SoC), for example. According to an embodiment, the AP 810 may further include a Graphic Processing Unit (GPU).

The communication module 820 may transmit and receive data when there are conveyed communications between other electronic devices connected with the electronic device 800 through a network. According to an embodiment, the communication module 820 may include a cellular module 821, a WiFi module 823, a BT module 825, a GPS module 827, an NFC module 828, and a Radio Frequency (RF) module 829.

The cellular module 821 may provide voice communication, video communication, a character service, or an Internet service through a communication network (e.g., an LTE, an LTE-A, a CDMA, a WCDMA, a UMTS, a WiBro, or a GSM, etc.). Also, the cellular module 821 may perform discrimination and authentication of an electronic device within a communication network using a subscriber identification module (e.g., a SIM card 824), for example. According to an embodiment, the cellular module 821 may perform at least a portion of functions that the AP 810 provides. For example, the cellular module 821 may perform at least a portion of a multimedia control function.

According to an embodiment, the cellular module 821 may include a Communication Processor (CP). Also, the cellular module 821 may be implemented with, for example, a SoC.

According to an embodiment, the AP 810 or the cellular module 821 (e.g., a CP) may load and process an instruction or data received from nonvolatile memories respectively connected thereto or from at least one of other elements at the nonvolatile memory. Also, the AP 810 or the cellular module 821 may store data received from at least one of other elements or generated by at least one of other elements at a nonvolatile memory.

Each of the WiFi module 823, the BT module 825, the GPS module 827, and the NFC module 828 may include a processor for processing data exchanged through a corresponding module, for example.

According to an embodiment, at least a portion (e.g., two or more components) of the cellular module 821, the WiFi module 823, the BT module 825, the GPS module 827, and the NFC module 828 may be included within one Integrated Circuit (IC) or an IC package. For example, at least a portion (e.g., a communication processor corresponding to the cellular module 821 and a WiFi processor corresponding to the WiFi module 823) of processors corresponding to the cellular module 821, the WiFi module 823, the BT module 825, the GPS module 827, and the NFC module 828 may be implemented with one SoC.

The RF module 829 may transmit and receive data, for example, an RF signal. Though not shown, the RF module 829 may include a transceiver, a Power Amplifier Module (PAM), a frequency filter, or Low Noise Amplifier (LNA), etc. Also, the RF module 829 may further include the following part for transmitting and receiving an electromagnetic wave in a space in wireless communication: a conductor or a conducting wire.

According to an embodiment, at least one of the cellular module 821, the WiFi module 823, the BT module 825, the GPS module 827, or the NFC module 828 may transmit or receive an RF signal through a separate RF module.

The SIM card 824 may be a card that includes a subscriber identification module and may be inserted to a slot formed at a specific position of the electronic device. The SIM card 824 may include unique identify information (e.g., Integrated Circuit Card Identifier (ICCID)) or subscriber information (e.g., Integrated Mobile Subscriber Identify (IMSI)).

The memory 830 may include an embedded memory 832 or an external memory 834. For example, the embedded memory 832 may include at least one of a volatile memory (e.g., a Dynamic RAM (DRAM), a Static RAM (SRAM), a Synchronous Dynamic RAM (SDRAM), etc.), or a nonvolatile memory (e.g., a One Time Programmable ROM (OTPROM), a Programmable ROM (PROM), an Erasable and Programmable ROM (EPROM), an Electrically Erasable or Programmable ROM (EEPROM), a mask ROM, a flash ROM, a NAND flash memory, a NOR flash memory, etc.).

According to an embodiment, the embedded memory 832 may be a Solid State Drive (SSD). The external memory 834 may further include a flash drive, for example, a Compact Flash (CF), a Secure Digital (SD), a Micro-Secure Digital (SD), a mini-SD, an extreme Digital (xD), or a memory stick. The external memory 834 may be functionally connected with the electronic device 800 through various interfaces. According to an embodiment, the electronic device 800 may further include storage (or storage medium) such as a hard disk drive.

The sensor module 840 may measure a physical quantity or may detect an operation state of the electronic device 800. The sensor module 840 may convert the measured or detected information to an electric signal. The sensor module 840 may include at least one of a gesture sensor 840A, a gyro sensor 840B, a pressure sensor 840C, a magnetic sensor 840D, an acceleration sensor 840E, a grip sensor 840F, a proximity sensor 840G, a color sensor 840H (e.g., RGB sensor), a living body sensor 840I, a temperature/humidity sensor 840J, an illuminance sensor 840K, or an UV sensor 840M. Additionally or generally, though not shown, the sensor module 840 may further include an E-nose sensor, an ElectroMyoGraphy sensor (EMG) sensor, an ElectroEncephaloGram (EEG) sensor, an ElectroCardioGram (ECG) sensor, a photoplethysmography (PPG) sensor, an InfraRed (IR) sensor, an iris sensor, or a fingerprint sensor, for example. The sensor module 840 may further include a control circuit for controlling at least one or more sensors included therein.

The input unit 850 may include a touch panel 852, a digital pen sensor 854, a key 856, or an ultrasonic input unit 858. The touch panel 852 may recognize a touch input using at least one of a capacitive type, a resistive type, an infrared type, or an ultrasonic wave type. Also, the touch panel 852 may further include a control circuit. In case of the capacitive type, a physical contact or proximity recognition is possible. The touch panel 852 may further include a tactile layer. In this case, the touch panel 852 may provide a tactile reaction to a user.

The digital pen sensor 854 may be implemented, for example, using a method, which is the same as or similar to receiving a user touch input, or using a separate sheet for recognition. The key 856, for example, may include a physical button, an optical key, or a keypad. The ultrasonic input unit 858 may be a device, which allows the electronic device 800 to detect a sound wave using a microphone (e.g., a microphone 888) and to determine data through an input tool generating an ultrasonic signal, and enables wireless recognition. According to an embodiment, the electronic device 800 may receive a user input from an external unit (e.g., a computer or a server) connected thereto using the communication module 820.

The display 860 may include a panel 862, a hologram device 864, or a projector 866. The panel 862 may be a liquid-crystal display (LCD) or an Active-Matrix Organic Light-Emitting Diode (AMOLED). The panel 862, for example, may be implemented to be flexible, transparent, or wearable. The panel 862 and the touch panel 852 may be implemented with one module. The hologram device 864 may show a three-dimensional image in a space using interference of light. The projector 866 may project light onto a screen to display an image. The screen, for example, may be positioned in the inside or outside of the electronic device 800. According to an embodiment, the display 860 may further include a control circuit for controlling the panel 862, the hologram device 864, or the projector 866.

The interface 870, for example, may include a High-Definition Multimedia Interface (HDMI) 872, a USB (Universal Serial Bus) 874, an optical interface 876, or a D-sub (D-subminiature) 878. The interface 870, for example, may include a Mobile High Definition Link (MHL) interface, a SD card/Multi-media cared (MMC) interface, or an Infrared Data Association (IrDA) standard interface.

The audio module 880 may convert a sound and an electric signal in dual directions. The audio module 880, for example, may process sound information that is input or output through the speaker 882, the receiver 884, the earphone 886, or the microphone 888.

The camera module 891 may be a unit that shoots a still picture and a moving picture. According to an embodiment, the camera module 891 may include one or more image sensors (e.g., a front sensor or a rear sensor), a lens (not shown), an Image Signal Processor (ISP) (not shown), or a flash (not shown) (e.g., an LED or a xenon lamp).

The power management module 895 may manage power of the electronic device 800. Though not shown, the power management module 895, for example, may include a Power Management Integrated Circuit (PMIC) a charger Integrated Circuit (IC), or a battery or fuel gauge.

The PMIC, for example, may be embedded in an IC or a SoC semiconductor. A charging method may be classified as a wired method or a wireless method. The charger IC may charge a battery and may prevent an overvoltage or an overcurrent from being input from a charger. According to an embodiment, the charger IC may include a charger IC for at least one of a wired charging method or a wireless charging method. The wireless charging method, for example, may be a magnetic resonance method, a magnetic induction method, or an electromagnetic method. An additional circuit for wireless charging, for example, circuits such as a coil loop, a resonance circuit, or a rectifier may be further provided.

The battery gauge, for example, may measure a remnant of the battery 896, a voltage, a current, or a temperature during charging. The battery 896 may store or generate electricity and may supply power to the electronic device 800 using the stored or generated electricity. The battery 896, for example, may include a rechargeable battery or a solar battery.

The indicator 897 may display the following specific state of the electronic device 800 or a portion (e.g., the AP 9810) thereof: a booting state, a message state, or a charging state. The motor 898 may convert an electric signal to mechanical vibration. Though not shown, the electronic device 800 may include a processing unit (e.g., a GPU) for supporting a mobile TV. The processing unit for supporting the mobile TV, for example, may process media data that is based on the standard of Digital Multimedia Broadcasting (DMB), Digital Video Broadcasting (DVB), or media flow.

Each of the above components of the electronic device according to an embodiment of the present disclosure may be implemented using one or more components, and a name of a relevant component may vary with on the kind of the electronic device. The electronic device according to various embodiments of the present disclosure may include at least one of the above components. Also, a portion of the components may be omitted, or additional other components may be further included. Also, some of the components of the electronic device according to the present disclosure may be combined to form one entity, thereby making it possible to perform the functions of the relevant components substantially the same as before the combination.

The term "module" used for the present disclosure, for example, may mean a unit including one of hardware, software, and firmware or a combination of two or more thereof. A "module", for example, may be interchangeably used with terminologies such as a unit, logic, a logical block, a component, a circuit, etc. The "module" may be a minimum unit of a component integrally configured or a portion thereof. The "module" may be a minimum unit performing one or more functions or a portion thereof. The "module" may be implemented mechanically or electronically. For example, the "module" according to the present disclosure may include at least one of an Application-Specific Integrated Circuit (ASIC) chip performing certain operations, a Field-Programmable Gate Arrays (FPGAs), or a programmable-logic device, known or to be developed in the future.

According to an embodiment, at least a portion of an apparatus (e.g., modules or functions thereof) or a method (e.g., operations) according to the present disclosure, for example, may be implemented by instructions stored in a computer-readable storage media in the form of a programmable module. The instruction, when executed by one or more processors, may perform a function corresponding to the instruction. At least a portion of the programming module may include the following for performing one or more functions: a module, a program, a routine, a set of instructions, or a process.

A computer-readable recording medium may include a hard disk, a magnetic media such as a floppy disk and a magnetic tape, an optical media such as Compact Disc Read Only Memory (CD-ROM) and a Digital Versatile Disc (DVD), a magneto-optical media such as a floptical disk, and the following hardware devices specifically configured to store and perform a program instruction (e.g., a programming module): Read Only Memory (ROM), Random Access Memory (RAM), and a flash memory. Also, a program instruction may include not only a mechanical code such as things generated by a compiler but also a high-level language code executable on a computer using an interpreter. The above hardware unit may be configured to operate via one or more software modules for performing an operation of the present disclosure, and vice versa.

A module or a programming module according to an embodiment of the present disclosure may include at least one of the above elements, or a portion of the above elements may be omitted, or additional other elements may be further included. Operations performed by a module, a programming module, or other elements according to an embodiment of the present disclosure may be executed sequentially, in parallel, repeatedly, or in a heuristic method. Also, a portion of operations may be executed in different sequences, omitted, or other operations may be added.

An electronic device according to various embodiments of the present disclosure may include an insertion terminal, a body part, and a support plate part. The body part may have an opposite surface opposite to a support surface, a step difference surface configured to have a step difference with the opposite surface and placed to be deeper from an insertion hole on the basis of an insertion direction of an insertion jack than the opposite surface, and an inclined surface joining the opposite surface and the step difference surface. The support plate part may transmit the force by which the insertion terminal shakes, to the body part through the inclined surface such that the force is transmitted to the body part, thereby making it possible to support the insertion terminal effectively.

The body part may have an extended surface that is curved and extended at one end of the opposite surface in a direction from the step difference surface toward the opposite surface. The support plate part may transmit the force by which the insertion terminal shakes, to the body part through the extended surface, thereby making it possible to support a shaking insertion terminal more stably.

The support plate part may transmit the force by which the insertion terminal shakes, to the body part through the step difference surface, thereby making it possible to support the insertion terminal more stably.

Also, embodiments of the present disclosure described and shown in the drawings are provided as examples to describe technical content and help understanding but do not limit the present disclosure. Accordingly, it should be interpreted that besides the embodiments listed herein, all modifications or modified forms derived based on the technical ideas of the present disclosure are included in the present disclosure as defined in the claims, and their equivalents.

What is claimed is:

1. An electronic device comprising:

an insertion terminal having an insertion hole into which an insertion jack is inserted;

a body part configured to support the insertion terminal at one side of the insertion terminal; and a support plate part having a support surface facing the insertion terminal and configured to support the insertion terminal at another side of the insertion terminal, wherein the body part has an opposite surface opposite to the support surface, and an inclined surface joining the opposite surface, wherein the support plate part transmits a force by which the insertion terminal shakes, to the body part through the inclined surface, and wherein at least a portion of the support plate part is bent and supports the inclined surface.

2. The electronic device of claim 1, wherein the body part further including extended surface having a curvature and extending from the opposite surface in a direction away from a step difference surface, and wherein the support plate part further transmits the force applied to the insertion terminal to the body part through the extended surface.

3. The electronic device of claim 1, wherein the force applied to the insertion terminal is further transmitted from the support plate part to the body part through the step difference surface.

4. The electronic device of claim 1, wherein the support plate part comprises a metal material.

5. The electronic device of claim 1, wherein the support plate part comprises at least one of a stainless steel (SUS) material and a material having rigidity equal to or higher than stainless steel.

6. The electronic device of claim 1, wherein the support plate part further comprises at least one projection shape contacting at least a portion of the body part providing frictional stance against relative movement between the support plate part and the body part.

7. The electronic device of claim 1, wherein the support plate part comprises a treated high friction surface contacting at least a portion of the body part providing frictional resistance against relative movement between the support plate and the body part.

8. The electronic device of claim 1, wherein the support plate part is coupled to the body part using an adhesive.

9. The electronic device of claim 1, wherein the support plate part is joined to the body part through a mechanical fastener.

10. The electronic device of claim 1, wherein a portion of the support plate part placed on the opposite surface is thicker than a portion of the support plate part placed on the inclined surface.

11. The electronic device of claim 3, wherein a portion of the support plate part disposed opposing at least one of the inclined surface and the step difference surface is thicker than a portion of the support plate part disposed opposing the opposite surface.

12. The electronic device of claim 1, wherein the support plate part further comprises at least one through-hole penetrating a full breadth of the support plate part.

13. The electronic device of claim 12, wherein the body part further comprises a first projection part penetrating the through-hole to couple the body part and the support plate part.

14. The electronic device of claim 1, wherein the support plate part further comprises a groove, and the body part further comprises a projection part inserted into the groove to couple the body part and the support plate part.

15. An electronic device comprising:

an insertion terminal having an insertion hole into which an insertion jack is inserted;

a body part configured to support the insertion terminal at one side of the insertion terminal; and a support plate part having a support surface facing to the insertion terminal and configured to support the insertion terminal at another side of the insertion terminal, wherein the body part has an opposite surface opposite to the support surface, a step difference surface configured to have a step difference with the opposite surface and placed to be deeper from the insertion hole on the basis of an insertion direction of an insertion jack than the opposite surface, and an inclined surface joining the opposite surface and the step difference surface, wherein the support plate part transmits a force by which the insertion terminal shakes, to the body part through the step difference surface without passing through the inclined surface, and wherein at least a portion of the support plate part is bent and supports the inclined surface.

16. The electronic device of claim 15, wherein the body part further including extended surface having a curvature and extending from the opposite surface in a direction away from the step difference surface, and wherein the support plate part further transmits the force applied to the insertion terminal to the body part through the extended surface.

17. The electronic device of claim 1, wherein a step difference surface is configured to have a step difference with the opposite surface and placed to be deeper from the insertion hole on the basis of an insertion direction of an insertion jack than the opposite surface.

* * * * *